US011225879B2

(12) United States Patent
Brunet et al.

(10) Patent No.: US 11,225,879 B2
(45) Date of Patent: Jan. 18, 2022

(54) ABRADABLE TURBOMACHINE ELEMENT PROVIDED WITH VISUAL WEAR INDICATORS

(71) Applicant: SAFRAN AIRCRAFT ENGINES, Paris (FR)

(72) Inventors: Antoine Robert Alain Brunet, Moissy-Cramayel (FR); Alexandre Franck Arnaud Chartoire, Moissy-Cramayel (FR); Eric Pierre Georges Lemarechal, Moissy-Cramayel (FR); David Joseph Serlan, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 20 days.

(21) Appl. No.: 16/738,159

(22) Filed: Jan. 9, 2020

(65) Prior Publication Data

US 2020/0277873 A1 Sep. 3, 2020

(30) Foreign Application Priority Data

Jan. 9, 2019 (FR) ..... 1900213

(51) Int. Cl.
*F01D 11/12* (2006.01)

(52) U.S. Cl.
CPC ..... *F01D 11/122* (2013.01); *F05D 2220/36* (2013.01); *F05D 2230/31* (2013.01); *F05D 2240/55* (2013.01); *F05D 2260/80* (2013.01)

(58) Field of Classification Search
CPC .... F01D 11/08; F01D 11/122; F05D 2220/36; F05D 2230/31; F05D 2240/55; F05D 2260/80; F05D 2230/72
See application file for complete search history.

(56) References Cited

U.S. PATENT DOCUMENTS

| | | | | |
|---|---|---|---|---|
| 8,079,806 | B2 * | 12/2011 | Tholen | F01D 11/125 415/171.1 |
| 8,695,445 | B2 * | 4/2014 | Laurer | F01D 5/12 73/865.8 |
| 9,556,743 | B2 * | 1/2017 | Chamberlain | C23C 4/10 |
| 10,125,625 | B2 * | 11/2018 | Maire | B29C 73/22 |
| 10,267,173 | B2 * | 4/2019 | Webb | F01D 11/122 |
| 10,428,674 | B2 * | 10/2019 | Sippel | F01D 11/122 |
| 10,544,698 | B2 * | 1/2020 | Stoyanov | F01D 11/001 |

(Continued)

FOREIGN PATENT DOCUMENTS

| | | |
|---|---|---|
| EP | 2990660 A1 | 3/2016 |
| EP | 3012414 A1 | 4/2016 |
| FR | 2995949 A1 | 3/2014 |

OTHER PUBLICATIONS

Preliminary Search Report issued in French Patent Application No. 1900213 dated Oct. 17, 2019.

*Primary Examiner* — Brian P Wolcott
(74) *Attorney, Agent, or Firm* — Pearne & Gordon LLP

(57) ABSTRACT

An abradable element (7) for a turbomachine comprises a body (8) formed from an abradable material and extending between a wear face (11) and a bottom (9). The body comprises blind cavities (12) opening up into the wear face and filled in with a material with a colour different from the colour of the material forming the body of the element (7) to form wear indicators of the wear face (11) of the element (7).

9 Claims, 3 Drawing Sheets

(56) References Cited

U.S. PATENT DOCUMENTS

| | | | | |
|---|---|---|---|---|
| 2012/0207586 | A1* | 8/2012 | Chehab | F01D 11/122 415/118 |
| 2016/0061049 | A1* | 3/2016 | Playford | F01D 11/122 415/9 |
| 2016/0061050 | A1* | 3/2016 | Keenan | F01D 11/122 415/118 |
| 2017/0159446 | A1* | 6/2017 | Graham | F01D 5/147 |
| 2020/0182083 | A1* | 6/2020 | Martin | F01D 21/045 |

* cited by examiner

-- PRIOR ART --

-- PRIOR ART --

ABRADABLE TURBOMACHINE ELEMENT PROVIDED WITH VISUAL WEAR INDICATORS

TECHNICAL FIELD

This invention relates to the measurement of wear of an abradable element used on a turbomachine, such as an abradable element supported by a turbojet fan case.

STATE OF PRIOR ART

A turbojet fan comprises a rotor supporting a series of blades surrounded by a fan case forming a stator and comprising a globally cylindrical internal face. In such an arrangement, there is a radially measurable clearance between the ends of the blades and the internal face of the stator that surrounds them, and that has a significant influence on engine performances.

Considering differential expansions that occur when the engine is in service and that partly control this clearance, the internal face of the stator is covered by abradable elements forming an abradable track at the ends of the blades.

During operation, the ends of the blades can rub in friction with the abradable elements forming a sort of groove, so that the radial clearance adjusts itself to a minimum necessary value with regard to the different operating conditions encountered.

Wear of the abradable elements becomes increasingly significant during the life of the turbojet. Therefore in order to prevent excessive deterioration of engine performances, these abradable elements are replaced as soon as they are excessively worn.

Thus, knowledge of the degree of wear of the abradable elements is necessary to determine whether or not they have to be replaced, and/or to plan a future replacement.

In practice, evaluating wear of abradable elements is a complex operation. As shown diagrammatically on FIG. 1, one possible approach is to take the impression of the hollow groove formed by the free ends of the blades. This is done by placing a resin sample 1 on the internal face 2 of the case so that it covers an intact portion 3 of the internal face 2 and the portion comprising the groove 4. Once it is dry, the resin sample 1 comprises an impression of the groove 4 that can be measured to determine the depth of this groove, in other words the wear being searched for. Despite all efforts, this method remains relatively imprecise and is difficult to implement.

Another solution is to use a set of different thickness shims to determine the thickest shim that can be engaged between one end of the blade and the groove, the thickness of the shim in question then corresponding to the wear being searched for. This other method is also imprecise and difficult to implement.

A laser type apparatus can also be used to measure the wear being searched for, but the measurement time is too long and it is expensive.

Another possibility illustrated on FIG. 2 is to create a grid of spot facings 6 with predetermined depths on the internal face of the new abradable element. Measurement of wear then consists of directly measuring the residual depth of the spot facings located in the groove to deduce the wear being searched for that corresponds to the difference between the initial depth and the residual depth.

This latter method is found to be relatively precise and fast, but the spot facings 6 present on the internal face of the abradable elements degrade the acoustic performances of the engine due to interaction between the supersonic flow at the tip of the blade with singularities formed by the spot facings present on the internal face of the abradable element.

The purpose of the invention is to provide an easily used and reliable solution for making a wear test.

PRESENTATION OF THE INVENTION

To achieve this, the purpose of the invention is an abradable element of a turbomachine case, comprising a body made of an abradable material in the form of a ring sector delimiting a wear face in the form of a portion of a cylinder, characterised in that this body comprises closed cavities opening up in the wear face, these cavities being filled by a material with a different colour from the material forming the body of the element to act as wear indicators of the element.

With this arrangement, wear of the abradable element can be detected by a simple visual check.

The invention also relates to an abradable element thus defined comprising cavities tapering outwards towards the wear face.

The invention also relates to an abradable element thus defined, wherein at least one cavity is delimited by a flank that is inclined by a predetermined angle relative to the wear face.

The invention also relates to an abradable element thus defined, in which the predetermined angle is between 5.6° and 5.8°.

The invention also relates to an abradable element thus defined, in which the cavities are conical holes.

The invention also relates to an abradable element thus defined, in which the cavities are spot facings with a predetermined inclination relative to the normal to the wear face.

The invention also relates to an abradable element thus defined, also comprising a spot facing tangent to at least one cavity, this spot facing being formed at an angle normal to the wear face.

The invention also relates to an abradable element thus defined, in which the infill material is an abradable material.

The invention also relates to a fan case equipped with an abradable element thus defined.

The invention also relates to a method of manufacturing an abradable element thus defined, comprising the following operations

- formation of a body made of an abradable material;
- formation of one or several cavities and possibly spot facings tangent to these cavities;
- fill in the cavities and spot facings if any with an infill material of a different colour from the colour of the abradable material forming the body.

DETAILED PRESENTATION OF PARTICULAR EMBODIMENTS

The basic concept of the invention is to provide cavities on the wear face of the abradable material, that are filled in with a material with a colour different from the abradable material, flush with the wear face. These cavities have special shapes that make it possible to see the state of wear, either directly or by measuring their extent.

Figure 1:
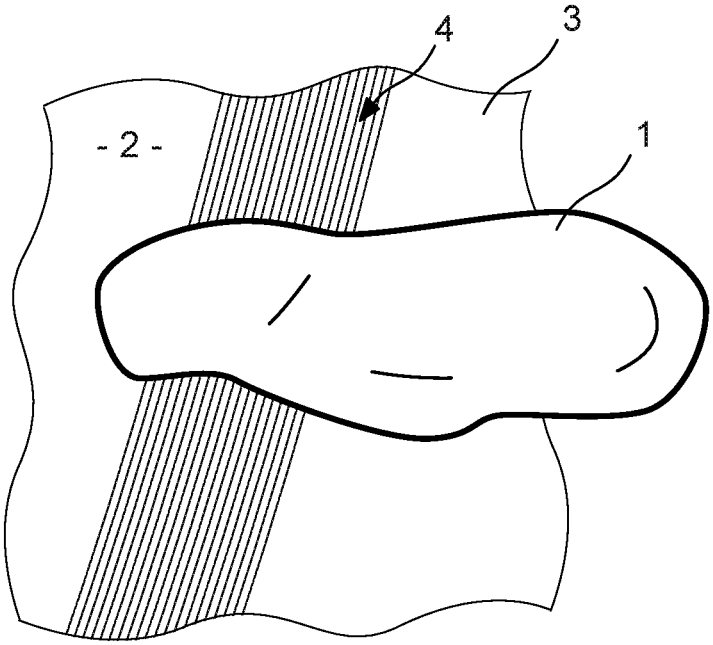
FIG. 1, already described, is a partial view showing a known technique for measuring the wear of an abradable element by taking an impression.
Figure 2:
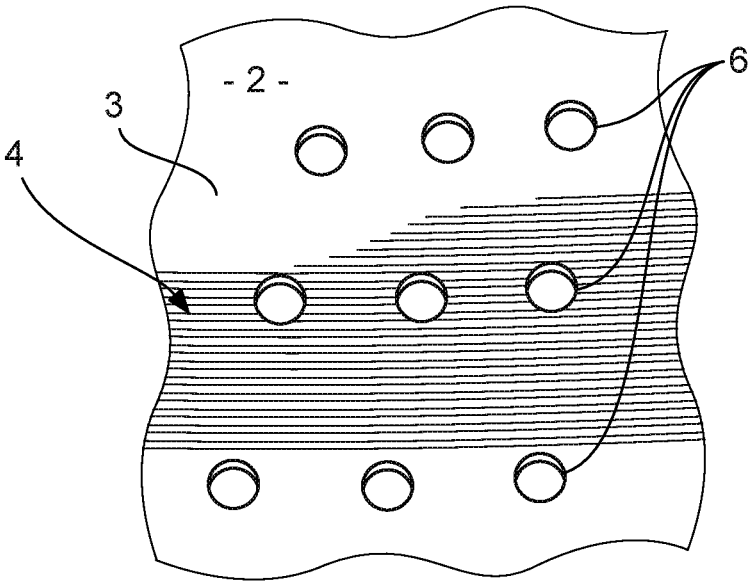
FIG. 2, already described, is a partial view showing a known arrangement comprising spot facings used to measure the wear of an abradable element.
Figure 3:
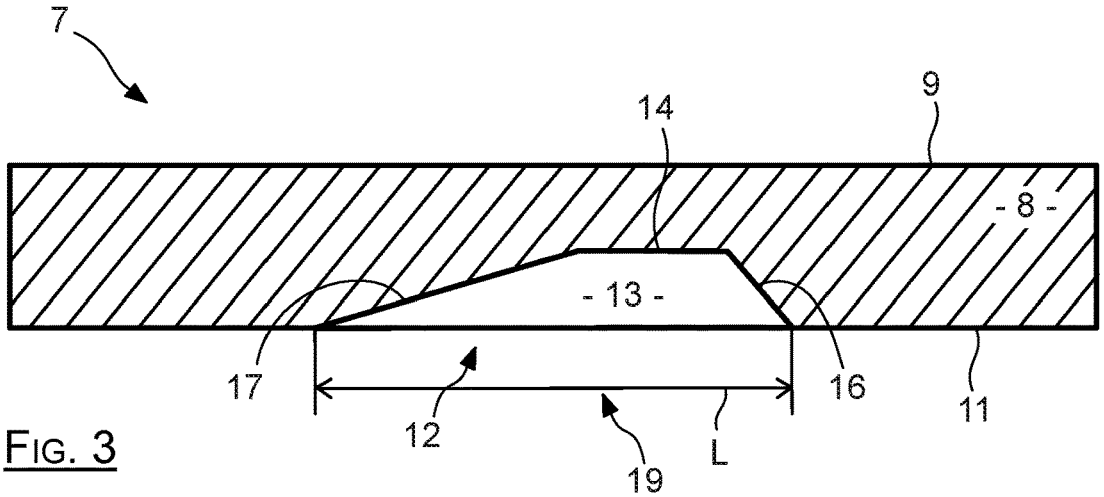
FIG. 3 is a sectional view of an abradable element according to a first embodiment of the invention in its new condition.

On FIG. 3, an abradable element 7 represented in section comprises a body 8 formed in a principal abradable material, delimited by a bottom 9 and a wear face 11, the distance between this bottom and this wear face corresponding to the thickness of the body 8.

This abradable element 7 is a fixed element arranged to be fixed on a stator element such as a fan case. The wear face 11 that is represented by a straight segment on FIG. 3 for simplification reasons, is actually a surface in the form of a portion of a cylinder centred on the axis of the turbojet when the element 7 is placed inside the case.

Thus, the body 8 that is shown diagrammatically by a rectangle on FIG. 3, is actually in the shape of a ring sector with a rectangular typical section. When a set of abradable elements is fixed on the internal face of a fan case, their bodies cooperate to form a ring, such that the wear faces of these bodies cooperate to delimit an internal cylindrical abradable track facing the fan blades.

A blind cavity 12 formed on the wear face 11 extends towards the bottom 9, being filled in by an infill material 13 with a colour different from the principal material. As can be seen on FIG. 3, this cavity is delimited by a bottom 14 oriented parallel to the bottom 9 and by oblique flanks 16, 17 prolonging this bottom towards the wear face 11. These flanks 16 and 17 are inclined relative to the wear face 11 so as to diverge such that the cavity 12 opens up towards the wear face 11. This cavity is this tapered outwards towards the wear face 11.

Since the cavity 12 is filled in by a material 13 with a colour different from the material 18, it forms a visible spot or land 19 on the wear face 11 that can be seen with the naked eye. When the abradable element is new as on FIG. 3, this spot 19 has an initial length denoted L.

Figure 4:
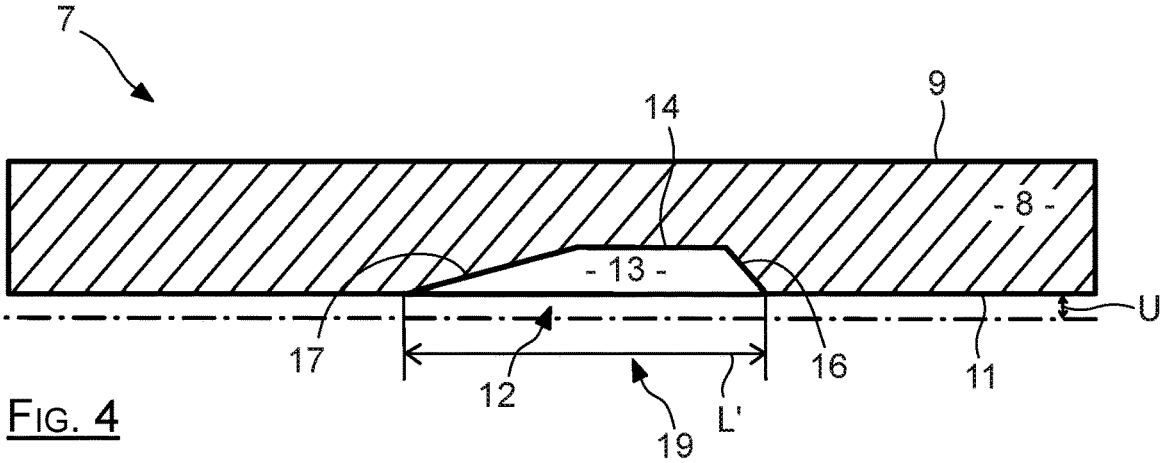
FIG. 4 is a sectional view of an abradable element according to the first embodiment of the invention when it has reached a certain degree of wear.

When the element 7 has reached a certain degree of wear, its wear face 11 has receded towards the bottom 9 by a wear value identified by U on FIG. 4. Considering the shape of the cavity 12 that is tapered outwards towards the wear face 11, this recession is represented by a reduction in the area of the cavity 12 visible at the wear face 11. Thus, wear of the abradable element 7 results in a reduction of the extent of the spot or land 19 formed by the infill material 13 on face 11.

In the case shown on FIG. 4, the residual length denoted L' of the land 19 is less than its initial length, the difference between these lengths L and L' being representative of the wear, in other words recession of the face 11.

Figure 5:
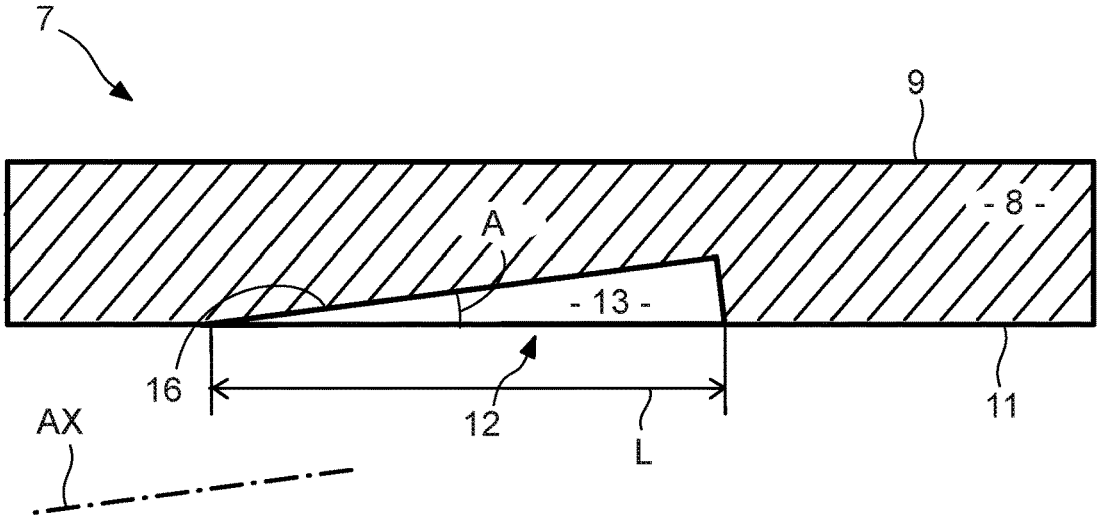
FIG. 5 is a sectional view of an abradable element according to a second embodiment of the invention in its new condition.

In the example in FIG. 5, the cavity 12 is a spot facing made with a cutter oriented along an axis AX forming a predetermined angle from the wear face 11. Once filled in with material 13, this cavity delimits a spot with a shape resembling an isosceles triangle having a base much shorter than the opposite sides when it is seen with the naked eye as it appears on the face 11. The length L of this cavity that corresponds to the distance between the base of the isosceles triangle and its opposite vertex is measured.

The angle A was advantageously chosen to provide a simple factor for deducing the state of wear from the difference between the lengths. By choosing an angle A equal to Arctangent (0.1), namely 5.7°, the difference between the initial length L and the residual length corresponds to ten times the wear being searched for.

Figure 6:
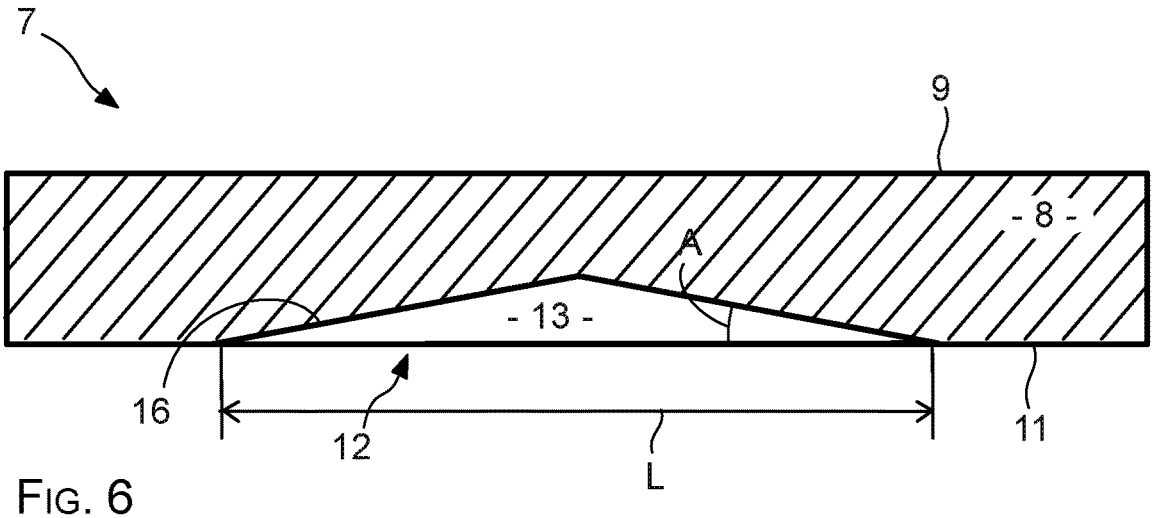
FIG. 6 is a sectional view of an abradable element according to a third embodiment of the invention in its new condition.

In the example shown in FIG. 6, the cavity is a conical hole, such that it is delimited by a single conical flank 16. This cavity can thus be formed in the principal material of the body 8 of the element 7 by drilling with an appropriate bit. Once this cavity 12 has been filled in with the material 13, it delimits a circular spot with length L in this case corresponding to its diameter.

The angle A formed by the flank 16 with the wear face 11 is also chosen to give a simple factor to deduce the state of wear from the difference between lengths. By choosing an angle A equal to 5.7°, the difference between the initial diameter and the residual diameter corresponds to twenty times the wear being searched for.

Figure 7:
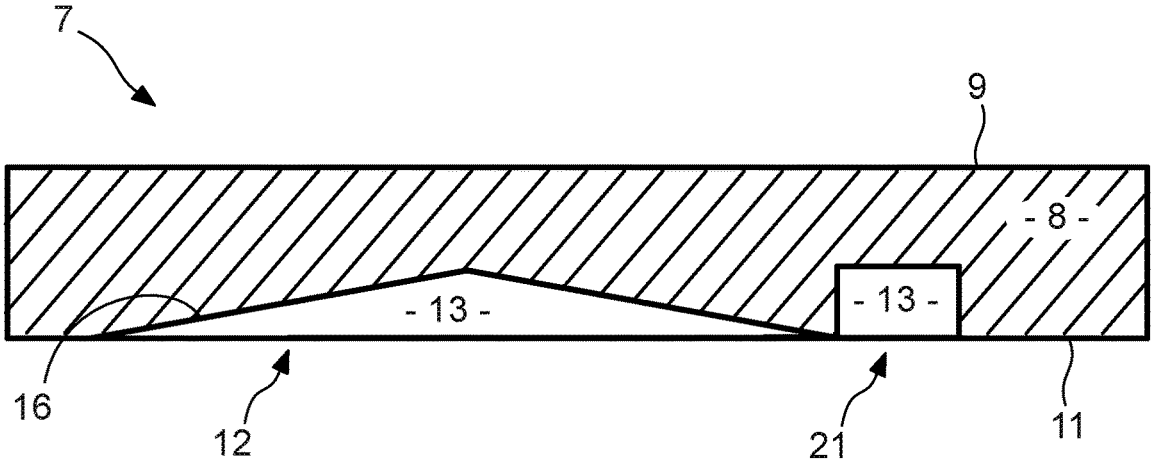
FIG. 7 is a sectional view of an abradable element according to a fourth embodiment of the invention in its new condition.
Figure 8:
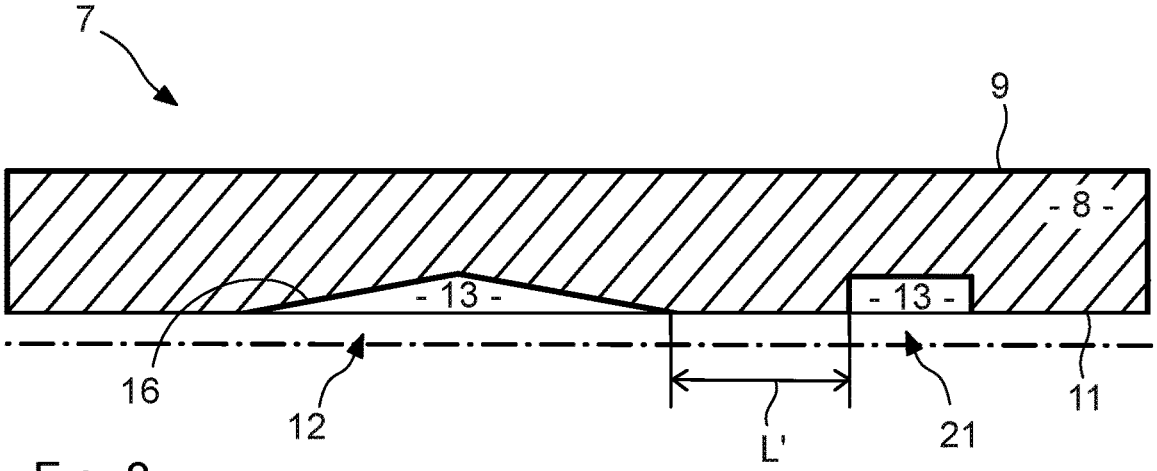
FIG. 8 is a sectional view of an abradable element according to the fourth embodiment of the invention when it has reached a certain degree of wear.

Alternatively, or additionally, a blind hole or spot facing 21 can also be made adjacent to the cavity 12 to even further facilitate evaluation of the degree of wear, as illustrated on FIGS. 7 and 8, this spot facing then also being filled in by the infill material 13.

In this case, the spot facing 21 is positioned to be tangent to the circumference of the cavity 12 in the form of a conical hole when the element 7 is new, being formed at an orientation normal to the face 11.

Under these conditions, the length separating the spot facing 21 from the cavity 12 is zero when the element is new, and this distance increases as the element 7 becomes worn, in other words as its face 11 recedes. Thus, as can be seen on FIG. 8, when the element 7 has reached a certain degree of wear, the length separating the cavity 12 from the spot facing 21 as can be seen on the wear face 11 is equal to L'.

In the example in FIGS. 7 et 8, if angle A is equal to 5.7°, the length L' corresponds to ten times the wear depth. Thus in this case, there is no need to know the initial length to be able to deduce the value of wear from the measurement, since the wear is directly proportional to the measured length.

In this example, the infill material 13 is also chosen to have a colour with a large contrast with the colour of the principal material.

The cavity 12 has a substantially arbitrary shape provided that it tapers outwards towards the wear face, so that recession of the wear face results in a reduction of the extent of the spot 19 that it forms on this face. This cavity may be a conical hole or a spot facing with a certain inclination from the wear face 11, such that this cavity can be relatively easy to form.

In general, the shapes of cavities are such that they are easy to machine, and that their section reduces from the wear face 11 towards the bottom 9. Advantageously, these cavities have a circular contour so that it suffices to measure their diameter. Furthermore, the dimensions of these cavities (for example 10 mm diameter) are large enough so that they can be seen by the naked eye and can be measured using a simple ruler graduated in millimetres, with an appropriate angle so that the wear level can be calculated from the measured value by mental arithmetic.

The relation between the measured length and the wear does not depend on the depth of the filled in cavity. Thus, regardless of the shape of the cavity, the depth can be chosen to act as a threshold: when the colour can no longer be seen, then maximum wear has been reached such that a repair is necessary.

The cavities can be placed at several axial positions, depending on the need; at the leading edge of fan blades, at the middle of the chord of these blades, or at their trailing edge.

Concerning the colours, an infill material 13 will advantageously be chosen to have a colour that has a good contrast with the colour of the principal material.

An abradable coloured material can be obtained from a basic abradable material on which an anodisation treatment has been made. A colouring powder or an appropriate paint can also be applied to change the colour of the material, knowing that an abradable material typically has a porous or perforated structure so that its colour can be modified over an entire predetermined thickness. In practice, colours can be chosen that have a sufficient contrast to the naked eye, for example such as blue and black.

In general, the invention is very well adapted to the case of turbojet fans that have a large diameter because in this configuration, the wear indicators according to the invention can be seen from outside the engine, in other words they are accessible and can be measured directly from outside the engine.

The invention claimed is:

1. An abradable element of a turbomachine case, comprising a body made of an abradable material in the form of a ring sector delimiting a wear face in the form of a portion of a cylinder, the body comprising closed cavities opening up in the wear face, the closed cavities being filled by a material with a different colour from a material forming the body of the abradable element to act as wear indicators of the abradable element, wherein at least one cavity of the closed cavities is delimited by a flank that is inclined by a predetermined angle relative to the wear face, and in that the value of the predetermined angle is between 5.6° and 5.8°.

2. The abradable element according to claim 1, wherein the at least one cavity is tapered outwards towards the wear face.

3. The abradable element according to claim 1, wherein the at least one cavity is a conical hole.

4. The abradable element according to claim 1, wherein the at least one cavity is a spot facing with a predetermined inclination relative to the wear face.

5. The abradable element according to claim 1, also comprising a spot facing tangent to the at least one cavity, the spot facing being formed at an angle normal to the wear face.

6. The abradable element according to claim 1, wherein the material that fills the closed cavities is an abradable material.

7. A method of making the abradable element according to claim 1, comprising operations for the:

formation of the body;

formation of the closed cavities;

filling in of the closed cavities with the material of the different colour from the colour of the material forming the body of the abradable element.

8. A turbojet fan case equipped with the abradable element according to claim 1.

9. The method of claim 7, wherein the formation of the closed cavities further includes forming spot facings tangent to the closed cavities.

* * * * *